US007185826B2

(12) United States Patent
Nanbu et al.

(10) Patent No.: US 7,185,826 B2
(45) Date of Patent: Mar. 6, 2007

(54) EXPANSION VALVE

(75) Inventors: Akinori Nanbu, Tokyo (JP); Satoshi Fukuda, Tokyo (JP); Kazuhiko Watanabe, Tokyo (JP)

(73) Assignee: Fujikoki Corporation, Tokyo (JP)

( * ) Notice: Subject to any disclaimer, the term of this patent is extended or adjusted under 35 U.S.C. 154(b) by 188 days.

(21) Appl. No.: 11/001,053

(22) Filed: Dec. 2, 2004

(65) Prior Publication Data

US 2005/0120741 A1 Jun. 9, 2005

(30) Foreign Application Priority Data

Dec. 5, 2003 (JP) ..... 2003-407821

(51) Int. Cl.
*G05D 23/12* (2006.01)

(52) U.S. Cl. ..... 236/92 B

(58) Field of Classification Search ..... 62/222, 62/225, 527; 236/92 B
See application file for complete search history.

(56) References Cited

U.S. PATENT DOCUMENTS

| | | | | |
|---|---|---|---|---|
| 4,542,852 | A | 9/1985 | Orth et al. | |
| 5,943,871 | A | 8/1999 | Ito et al. | |
| 6,062,484 | A * | 5/2000 | Eybergen | 236/92 B |
| 6,145,753 | A * | 11/2000 | Yano et al. | 236/92 B |
| 6,189,800 | B1 | 2/2001 | Fujimoto et al. | |
| 6,293,472 | B1 * | 9/2001 | Yano | 236/92 B |
| 6,296,194 | B1 * | 10/2001 | Hirota et al. | 236/92 B |
| 6,427,243 | B2 * | 8/2002 | Kobayashi et al. | 236/92 B |
| 6,560,982 | B2 * | 5/2003 | Kobayashi et al. | 62/225 |
| 2001/0042851 | A1 | 11/2001 | Oh | |

FOREIGN PATENT DOCUMENTS

| | | | |
|---|---|---|---|
| EP | 1 118 822 | A2 | 7/2001 |
| JP | 10-253199 | A * | 9/1998 |
| JP | 2000-346494 | A | 12/2000 |

OTHER PUBLICATIONS

European Search Report (3 pages).

* cited by examiner

*Primary Examiner*—Mohammad M. Ali
(74) *Attorney, Agent, or Firm*—Rader, Fishman & Grauer PLLC

(57) ABSTRACT

The invention provides an expansion valve maintaining the functions of the prior art expansion valve and at the same time realizing a simple arrangement with less components and less required number of assembly steps, and enabling to cut down assembly costs. A first passage 11 through which refrigerant flowing toward an evaporator 2 travels and a second passage 12 through which refrigerant flowing from the evaporator 2 toward a compressor 3 travels are formed within a valve body 10. In response to the temperature of the refrigerant traveling in the second passage 12, a valve actuating member 40' actuates a valve means 20 disposed in the valve body 10 to control the flow of the refrigerant entering the evaporator 2. A seal member 50 sealing the area between the first and second passages 11 and 12 is disposed between the valve body 10 and the valve actuating member 40'. A stopper portion 44 of the seal member 50 is integrally formed in advance to the valve actuating member 40'.

4 Claims, 4 Drawing Sheets

EXPANSION VALVE

The present application is based on and claims priority of Japanese patent application No. 2003-407821 filed on Dec. 5, 2003, the entire contents of which are hereby incorporated by reference.

BACKGROUND OF THE INVENTION

1. Field of the Invention

The present invention relates to an expansion valve for a refrigerant disposed in a refrigeration cycle of an air conditioner, a refrigeration device or the like.

2. Description of the Related Art

Japanese Patent Laid-Open Publication No. 2000-346494 (patent document 1) discloses an example of a prior art expansion valve widely used in a refrigeration cycle of an air conditioner of a vehicle or the like.

FIGS. 3 and 4 are referred to in describing the prior art expansion valve. FIG. 3 is a vertical cross-sectional view, and FIG. 4 is an explanatory view showing the relevant portion thereof.

As illustrated in FIG. 3, an expansion valve 1 is formed of a rectangular column-shaped valve body 10, and the valve body 10 has a first passage 11 of a refrigeration cycle 4 through which the refrigerant flowing toward an evaporator 2 passes and a second passage 12 through which the refrigerant flowing from the evaporator 2 toward a compressor 3 passes, which are formed to the valve body 10 in a vertically separated manner.

The valve body 10 further has an orifice 13 and a valve chamber 15 formed to the first passage 11, a spherical valve means 20 arranged in the valve chamber 15 for controlling the flow of refrigerant passing through the orifice 13, and an adjustment screw 24 of a spring 23 for pushing the valve means 20 toward the direction of the orifice 13 via a valve member 21.

The adjustment screw 24 is adjustably screwed onto amounting hole 16 formed to a bottom surface of the valve body 10 and communicated with the valve chamber 15, and an O-ring 24*a* is attached to the adjustment screw 24 in order to assure that the valve body 10 is maintained airtight. This adjustment screw 24 and the spring 23 are used to adjust the opening of the valve means 20 with respect to the orifice 13.

Reference number 11*a* denotes an inlet port through which the refrigerant flowing from a compressor 3 via a condenser 6 and a receiver 5 toward the evaporator 2 enters, the inlet port 11*a* being connected to the valve chamber 15, and reference number 11*b* denotes an outlet port leading to the evaporator 2.

The valve body 10 has a small diameter hole 14 and a large diameter hole 14*a* larger than the hole 14 that are formed concentrically with the orifice 13 and penetrating the second passage 12 so as to enable a valve actuating member 40 (described later) to be disposed for providing driving force to the valve member 20 and for opening and/or closing the orifice 13 in response to the exit temperature of the evaporator 2. On the upper end of the valve body 10 is formed a screw hole 17 for fixing a power element portion 30 functioning as the heat sensing portion. A ring-shaped seal member 50 is disposed to the inner side of the large diameter hole 14*a*.

The power element portion 30 is provided with a diaphragm 31, an upper cover 34 and a lower cover 35 welded to each other and sandwiching the diaphragm 31 so as to define above and below the diaphragm 31 an upper pressure actuated chamber 32 and a lower pressure actuated chamber 33, and a plug member 36 for sealing a predetermined refrigerant working as a diaphragm actuating fluid to the upper pressure actuated chamber 32. The lower cover 35 is attached by screw engagement onto the screw hole 17 via a packing 37. The lower pressure actuated chamber 33 is communicated with the second passage 12 through a pressure equalizing hole 18 formed concentrically with respect to the center line of the orifice 13.

The refrigerant vapor exiting the evaporator 2 travels through the second passage 12, and the passage 12 functions as a gas-phase refrigerant passage, with the pressure of the refrigerant vapor loaded to the lower pressure actuated chamber 33 through the pressure equalizing hole 18. Reference number 12*a* denotes an inlet port for the refrigerant, and reference number 12*b* denotes an outlet port through which the refrigerant exits toward the compressor 3.

Further, at the center of the valve body 10 is disposed a rod-shaped valve actuating member 40. The valve actuating member 40 has a top portion 42 formed in the shape of a large-diameter disk disposed within the lower pressure actuated chamber 33 and that comes into contact with the center area of the lower surface of the diaphragm 31. The valve actuating member 40 is passed through the second passage 12 and the large diameter hole 14*a* and is slidably disposed within the small diameter hole 14, for transmitting the exit temperature of the refrigerant from the evaporator 2 to the lower pressure actuated chamber 33 and to provide driving force by sliding in the vertical direction in response to the displacement of the diaphragm 31 accompanying the difference in pressure between the upper and lower pressure actuated chambers 32 and 33. Furthermore, the lower portion of the valve actuating member 40 is formed as a small-diameter portion 43, and the lower end thereof is in contact with the valve means 20.

Therefore, the valve actuating member 40 extending from the lower surface of the diaphragm 31 to the orifice 13 of the first passage 11 is concentrically disposed in the pressure equalizing hole 18. Further, the small diameter portion 43 of the valve actuating member 40 inserted to the orifice 13 is formed narrower than the inner diameter of the orifice 13, so as to allow refrigerant to pass through the orifice 13.

Further, as shown in FIG. 4, the valve actuating member 40 has a retaining ring 60 attached thereto for retaining the seal member 50 in position within the hole 14*a* resisting the high refrigerant pressure from the first passage 11. An annular groove 41 is formed to the valve actuating member 40, and the retaining groove 60 made of metallic material is elastically fit to the annular groove 41.

A known diaphragm actuating fluid is filled in the upper pressure actuated chamber 32 of the power element portion 30, and the heat of the refrigerant from an evaporator 2 flowing through the second passage 12 is transmitted to the diaphragm actuating fluid through the valve actuating member 40 disposed to pass through the second passage and the pressure equalizing hole 18 communicating with the second passage 12, the top portion 42 and the diaphragm 31.

The diaphragm actuating fluid gasifies in response to the heat being transmitted thereto, and applies pressure to the upper surface of the diaphragm 31. The diaphragm 31 is displaced in the vertical direction by the difference in pressure of the diaphragm drive gas applied to the upper surface thereof and the pressure applied to the lower surface thereof. The vertical displacement of the center portion of the diaphragm 31 is transmitted via the valve actuating member 40 to the valve means 20, and moves the valve means 20 toward or away from the valve seat of the orifice 13. As a result, the flow of refrigerant is controlled.

That is, since the temperature of the low-pressure gas-phase refrigerant exiting the evaporator 2 is transmitted to the upper pressure actuated chamber 32, the pressure in the upper pressure actuated chamber 32 is changed in response to this temperature, and when the temperature at the exit of the evaporator 2 is raised, in other words, when the heat load of the evaporator 2 is increased, the pressure within the upper pressure actuated chamber 32 is increased, and in response, the valve actuating member 40 is driven downward to lower the valve means 20, and as a result, the opening of the orifice 13 is widened.

By this movement, the supply of refrigerant to the evaporator 2 is increased, lowering the temperature of the evaporator 2. Thus, the temperature of the refrigerant exiting the evaporator 2 is lowered. In other words, when the heat load of the evaporator 2 is reduced, the valve means 20 is driven in the opposite direction from that described above, narrowing the opening of the orifice 13, by which the amount of refrigerant supplied to the evaporator 2 is reduced and the temperature of the evaporator 2 is raised.

According to the prior art expansion valve described above, there is a need to form an annular groove 41 to the valve actuating member 40, and further, there is a need to elastically deform, slide, and fit the retaining ring 60 to the annular groove 41. This not only increases the number of necessary components, but also increases the number of required steps for assembling the valve.

SUMMARY OF THE INVENTION

The present invention is aimed at solving the problems mentioned above, and the object is to provide an expansion valve maintaining the conventional functions but having a simplified arrangement, thereby enabling to reduce the number of components and assembly steps, and to cut down the assembly costs.

In order to achieve the above-mentioned objects, the expansion valve according to a first aspect of the present invention comprises a valve body, and a seal member interposed between the valve body and a valve actuating member for actuating a valve means to be opened and closed, wherein a stopper portion for the seal member is integrally formed in advance to the valve actuating member.

As for the practical means of the above expansion valve, the stopper portion is integrally formed to the valve actuating member by forging.

More specifically, the present invention provides the expansion valve mentioned above, wherein the expansion valve has a first passage through which a refrigerant flowing toward an evaporator passes and a second passage through which the refrigerant flowing from the evaporator toward a compressor passes formed within the valve body, for controlling a flow rate of the refrigerant flowing into the evaporator by actuating the valve means within the valve body by the valve actuating member in response to a temperature of the refrigerant passing through the second passage, and wherein the seal member sealing an area between the first and second passages is disposed between the valve body and the valve actuating member within the valve body.

According to the above inventions, an expansion valve maintaining all the functions of the conventional expansion valve but requiring less number of components and less number of assembly steps is provided, according to which the manufacture costs can be cut down.

DETAILED DESCRIPTION OF THE PREFERRED EMBODIMENTS

Figure 1:
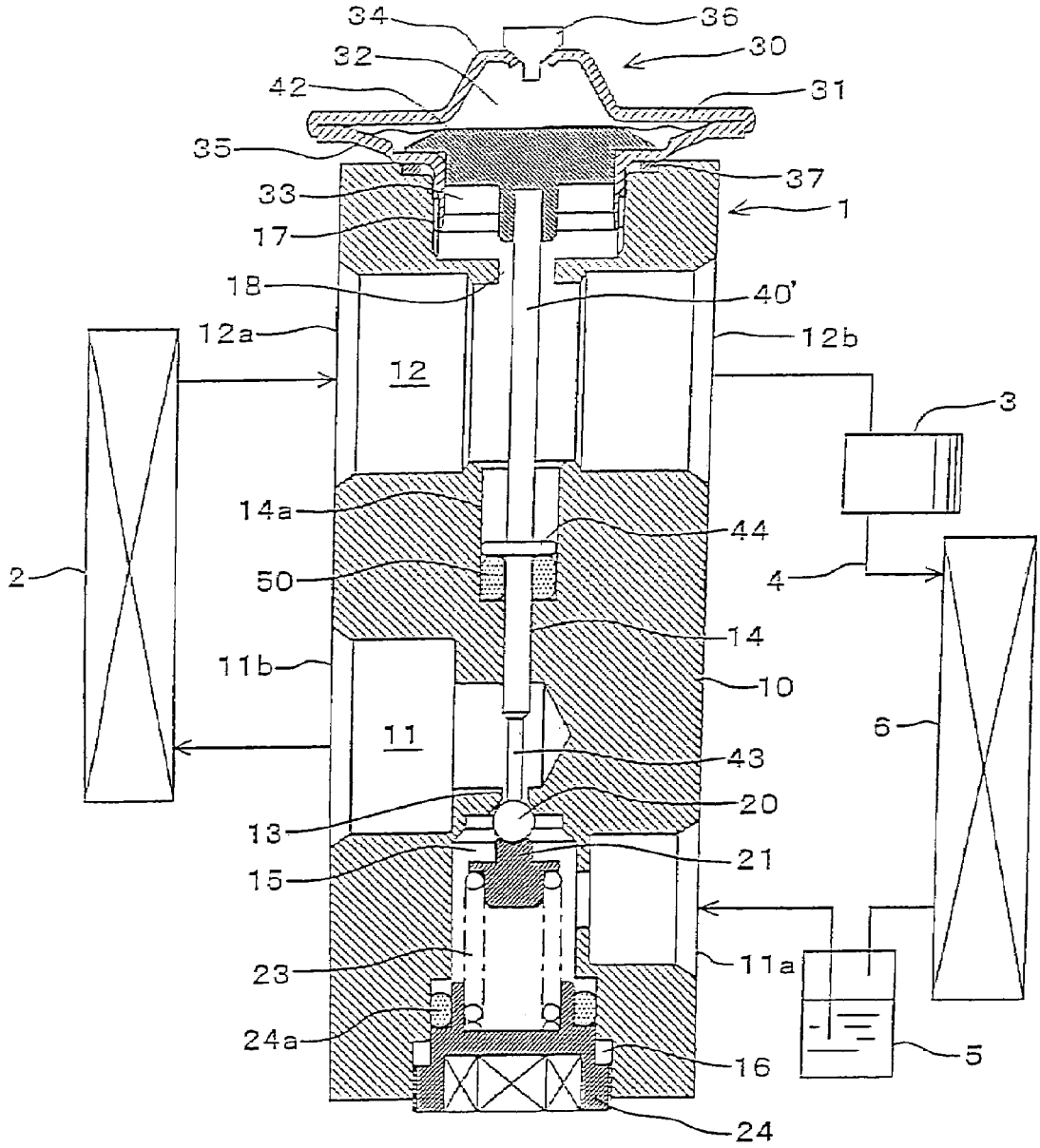
FIG. 1 is a vertical cross-sectional view of the expansion valve according to the present invention.
Figure 2:
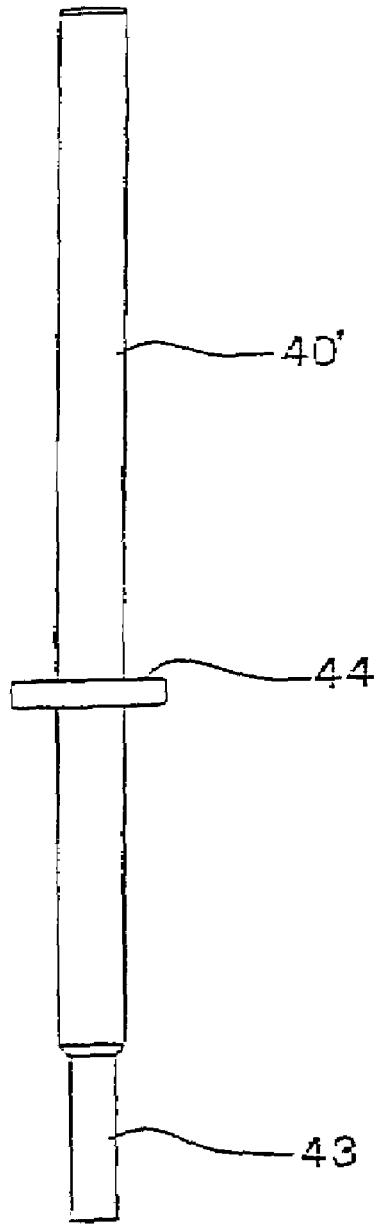
FIG. 2 is an explanatory view showing the relevant portion of the expansion valve of FIG. 1.
Figure 3:
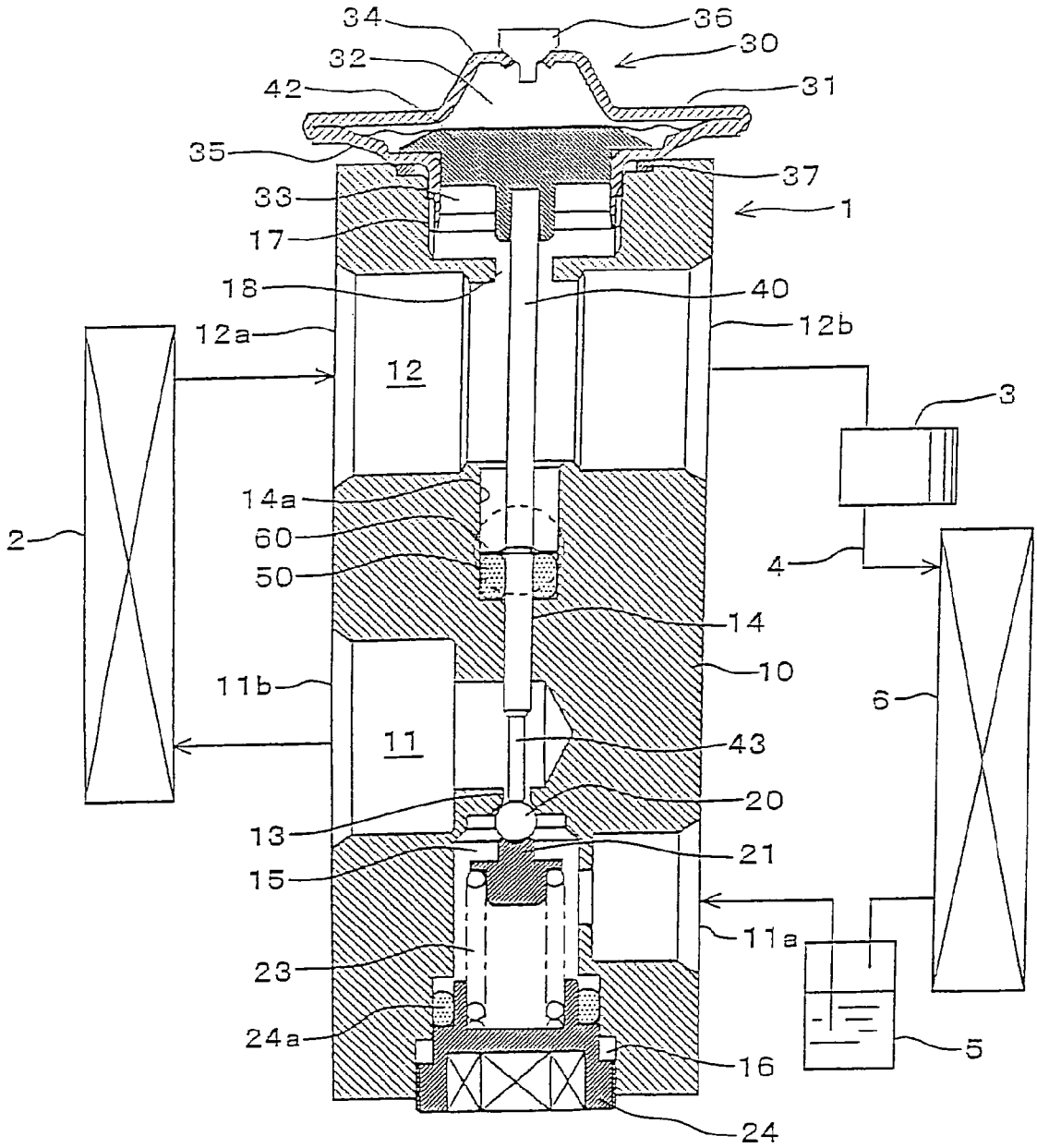
FIG. 3 is a vertical cross-sectional view of the expansion valve according to the prior art.

Now, the preferred embodiment of the expansion valve according to the present invention will be described with reference to the drawings. FIG. 1 is a vertical cross-sectional view of the expansion valve according to the present invention, and FIG. 2 is an explanatory view of the relevant portion of FIG. 1. According to the present embodiment, the components in FIGS. 1 and 2 that are identical to those of the prior art example illustrated in FIGS. 3 and 4 are denoted by the same reference numbers, and the explanations thereof are omitted.

At the center of a valve body 10 is disposed a rod-shaped valve actuating member 40' made of stainless steel, similar to the prior art arrangement. That is, the valve actuating member 40' has a top portion 42 formed in a disk-like shape with a large diameter disposed within a lower pressure actuated chamber 33 and that comes into contact with the center portion of a lower surface of a diaphragm 31. The valve actuating member 40' is passed through a second passage 12 and a large-diameter hole 14*a* and is slidably disposed within a small-diameter hole 14, so as to transmit the temperature of the refrigerant at the exit of an evaporator 2 to the lower pressure actuated chamber 33 and to slide in the vertical direction in response to the displacement of the diaphragm 31 accompanying the pressure difference between the upper pressure actuated chamber 32 and the lower pressure actuated chamber 33, thereby providing actuating force. The bottom portion of the valve actuating member 40' is formed as a small-diameter portion 43, and the lower end thereof comes into contact with a valve means 20.

Accordingly, the valve actuating member 40' extending from the lower surface of the diaphragm 31 to an orifice 13 of a first passage 11 is disposed concentrically within a pressure equalizing hole 18.

Figure 4:
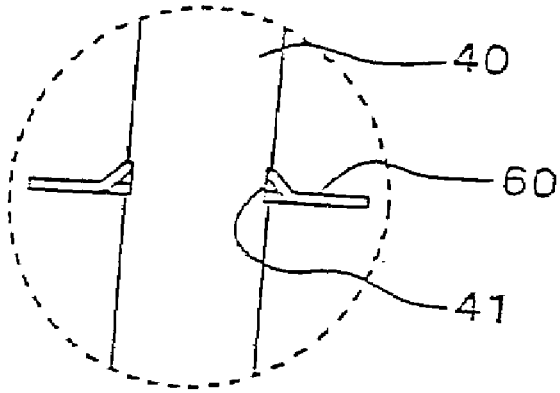
FIG. 4 is an explanatory view showing the relevant portion of the expansion valve of FIG. 3.

Moreover, according to the valve actuating member 40' of the present embodiment, a flange-shaped stopper portion 44 is formed integrally to the valve actuating member at a position somewhat lower than the longitudinal center portion thereof, as shown specifically in FIG. 2, in replacement of the mounting means for a retaining ring 60 according to the prior art example (refer to FIG. 4). The integral forming process can be realized for example through a known cold forging process. Of course, other processing means can be adopted to form the integral member.

A known diaphragm actuating fluid is filled in the upper pressure actuated chamber 32 of the power element portion 30, and the heat of the refrigerant from an evaporator 2 flowing through the second passage 12 is transmitted to the diaphragm actuating fluid through the valve actuating member 40' disposed to pass through the second passage 12 and the pressure equalizing hole 18 communicating with the second passage 12, the top portion 42 connected to the valve actuating member 40' and the diaphragm 31.

The diaphragm actuating fluid gasifies in response to the heat being transmitted thereto, and applies pressure to the upper surface of the diaphragm 31. The diaphragm 31 is displaced in the vertical direction by the difference in pressure of the diaphragm drive gas applied to the upper surface thereof and the pressure applied to the lower surface thereof. The vertical displacement of the center portion of the diaphragm 31 is transmitted via the valve actuating member 40' to the valve means 20, and moves the valve means 20 toward or away from the valve seat of the orifice 13. As a result, the flow of refrigerant is controlled.

That is, since the temperature of the refrigerant at the exit of the evaporator 2, in other words, the temperature of the low-pressure gas-phase refrigerant exiting the evaporator 2 is transmitted to the upper pressure actuated chamber 32, the pressure in the upper pressure actuated chamber 32 is changed in response to this temperature, and when the temperature at the exit of the evaporator 2 is raised, in other words, when the heat load of the evaporator 2 is increased, the pressure within the upper pressure actuated chamber 32 is increased, and in response, the valve actuating member 40' is driven downward to lower the valve means 20, and as a result, the opening of the orifice 13 is widened.

By this movement, the supply of refrigerant to the evaporator 2 is increased, lowering the temperature of the evaporator 2. Thus, the temperature of the refrigerant exiting the evaporator 2 is lowered. In other words, when the heat load of the evaporator 2 is reduced, the valve means 20 is driven in the opposite direction from that described above, narrowing the opening of the orifice 13, by which the amount of refrigerant supplied to the evaporator 2 is reduced and the temperature of the evaporator 2 is raised.

As for the means for retaining a seal member 50 to position according to the present embodiment, a flange-shaped stopper portion 44 is integrally formed to the valve actuating member 40' in replacement of the means for mounting the retaining ring 60 according to the prior art, according to which the number of components and the number of assembly steps of the expansion valve is effectively reduced, and as a result, the costs related to the components and assembling processes can be cut down.

What is claimed is:

1. An expansion valve, comprising:

a valve body including a central valve body portion having a hole extending longitudinally therethrough, the hole having a small diameter hole portion and a large diameter hole portion communicating with the small diameter hole portion in a stepped-down manner to form an annular wall extending radially outwardly at a location where the small diameter portion and the large diameter portion communicate with each other;

a seal member sized to be received in the large diameter hole at least adjacent to the annular wall;

a valve actuating member for actuating a valve means to be opened and closed with the valve actuating member being in a form of a rod having a first rod portion and a second rod portion integrally connected to the first rod portion, the first rod portion having a first rod diameter sized to be received by the small diameter hole portion for close-fitting slidable movement therein; and a stopper integrally formed to the valve actuating member at an intermediate position on the first rod portion, the stopper extending radially from the first rod portion and sized for close-fitting slidable movement within the large diameter hole portion, wherein the seal member is interposed between the stopper and the annular wall.

2. The expansion valve according to claim 1, wherein the stopper is integrally formed to the valve actuating member by forging.

3. The expansion valve according to claim 1 or claim 2, the expansion valve further having formed within the valve body a first passage through which a refrigerant flowing toward an evaporator passes and a second passage through which the refrigerant flowing from the evaporator toward a compressor passes, wherein a flow rate of the refrigerant flowing into the evaporator is controlled by actuating the valve means within the valve body via the valve actuating member in response to a temperature of the refrigerant passing through the second passage, and wherein the seal member sealing an area between the first and second passages is disposed between the valve body and the valve actuating member within the valve body.

4. The expansion valve according to claim 1, wherein the seal member simultaneously contacts both the stopper and the annular wall.

* * * * *